US011118395B2

(12) United States Patent
Dintheer

(10) Patent No.: US 11,118,395 B2
(45) Date of Patent: Sep. 14, 2021

(54) SEALING DEVICE

(71) Applicant: ASSA ABLOY (Schweiz) AG, Richierswil (CH)

(72) Inventor: Andreas Dintheer, Illnau (CH)

(73) Assignee: ASSA ABLOY (Schweiz) AG, Richterswil (CH)

( * ) Notice: Subject to any disclaimer, the term of this patent is extended or adjusted under 35 U.S.C. 154(b) by 0 days.

(21) Appl. No.: 16/096,817

(22) PCT Filed: May 4, 2016

(86) PCT No.: PCT/EP2016/060038

§ 371 (c)(1),
(2) Date: Oct. 26, 2018

(87) PCT Pub. No.: WO2017/190779

PCT Pub. Date: Nov. 9, 2017

(65) Prior Publication Data

US 2019/0128054 A1 May 2, 2019

(51) Int. Cl.

| | |
|---|---|
| ***E06B 7/21*** | (2006.01) |
| ***E06B 3/46*** | (2006.01) |
| ***E06B 7/215*** | (2006.01) |
| ***E06B 7/23*** | (2006.01) |

(52) U.S. Cl.
CPC ..... *E06B 7/21* (2013.01); *E06B 3/46* (2013.01); *E06B 7/215* (2013.01); *E06B 7/2316* (2013.01)

(58) Field of Classification Search
CPC ..... E06B 7/21
See application file for complete search history.

(56) References Cited

U.S. PATENT DOCUMENTS

| | | | | |
|---|---|---|---|---|
| 7,143,546 | B2 * | 12/2006 | Griffis | B60J 5/0497 49/308 |
| 8,381,445 | B2 * | 2/2013 | Hans | E06B 7/21 49/316 |
| 9,816,314 | B2 * | 11/2017 | Eansor | E06B 7/21 |
| 10,167,666 | B2 * | 1/2019 | Siller | E06B 7/205 |
| 2018/0320437 | A1 * | 11/2018 | Dintheer | E06B 7/215 |

(Continued)

FOREIGN PATENT DOCUMENTS

| | | | |
|---|---|---|---|
| DE | 8214413 | U1 | 9/1982 |
| DE | 8810254 | U1 | 11/1988 |
| DE | 29916090 | U1 | 3/2001 |

(Continued)

*Primary Examiner* — Catherine A Kelly
(74) *Attorney, Agent, or Firm* — The Webb Law Firm

(57) ABSTRACT

A sealing device of a sliding door having a slidably mounted door leaf has a drop-down seal having a sealing strip and a lowering mechanism for automatically lowering and raising the sealing strip. The lowering occurs against a restoring force. The sealing device also has an activation unit for activating the drop-down seal. The activation unit has a contact surface, which is directed upward in the lowering direction, and a contact element, which lies against said contact surface during the closing of the door leaf and thereby actuates the drop-down seal. In this way, the weight of the door leaf can be used for the lowering of the sealing strip. Furthermore, a position in which the restoring force does not influence a sliding motion of the door leaf in the longitudinal direction of the sealing strip can be achieved.

18 Claims, 15 Drawing Sheets

(56) References Cited

U.S. PATENT DOCUMENTS

| | | | | |
|---|---|---|---|---|
| 2019/0136609 | A1* | 5/2019 | Dintheer | E06B 3/46 |
| 2019/0368266 | A1* | 12/2019 | Goldfinch | E05D 15/0626 |

FOREIGN PATENT DOCUMENTS

| | | | | |
|---|---|---|---|---|
| EP | 0338974 | A2 | 10/1989 | |
| EP | 0509961 | A1 | 10/1992 | |
| EP | 1447514 | A2 | 8/2004 | |
| EP | 2085559 | A2 | 8/2009 | |
| EP | 2476856 | A2 * | 7/2012 | E06B 7/21 |
| EP | 2476857 | A2 | 7/2012 | |
| GB | 2516977 | A | 2/2015 | |
| JP | 200689919 | A | 4/2006 | |

* cited by examiner

SEALING DEVICE

CROSS-REFERENCE TO RELATED APPLICATION

This application is the United States national phase of International Application No. PCT/EP2016/060038 filed May 4, 2016, the disclosure of which is hereby incorporated in its entirety by reference.

BACKGROUND OF THE INVENTION

Field of the Invention

The present invention relates to a sealing device for activating a drop-down seal, to a sliding door having a sealing device of this type, and to an activation unit of a sealing device of this type.

Description of Related Art

Drop-down seals are used for sealing doors and windows. Said drop-down seals prevent light from passing through and offer an acoustic protection as well as a protection against draft and smoke. In the case of external doors, said drop-down seals moreover serve as splash protection in the event of rain, and depending on the embodiment can also protect against flooding.

Lowerable door and window seals are usually composed substantially of a housing in the form of a hat-shaped or U-shaped profiled rail that is open toward the bottom, a sealing strip that is held so as to be liftable and lowerable in said housing, said sealing strip having a sealing profile as well as an activation mechanism for lifting and lowering the sealing strip. The activation mechanism in proven drop-down seals has leaf springs which at a first location are fastened to the housing, at a second location fastened to the sealing strip, and at a third location fastened to a slide. The slide usually transitions to an activation button which projects from the housing on one side or both sides. In the closing of the door, the activation button on the door frame is depressed, and the sealing strip is automatically lowered counter to the spring force of the leaf springs and is pressed in a sealing manner against the floor. The activation button is released again in the opening of the door, and the sealing strip is automatically lifted. Further types of activation mechanisms, for example lever assemblies, are known. Door seals of this type are known, for example, from EP 0 338 974, DE 299 16 090, and EP 0 509 961. EP 2 085 559 discloses an automatically lowerable sealing device in which the lowering mechanism is activated by the influence of lateral force.

EP 2 476 857 discloses a drop-down seal for sliding doors. The drop-down seal is embodied as described above, and has an activation button that projects from the seal housing. The door frame in the region of the secondary closing edge has a detent element having a downwardly inclined oblique face and a receptacle pocket that runs in a straight line. In the closing of the door leaf, a first roller that is attached to the door leaf runs along said oblique face and herein pulls downward a spring-loaded slide. A second roller that is disposed on the slide pushes a lever onto the activation button which, on account thereof, activates the activation mechanism and lowers the sealing strip. In the further closing of the door leaf, the first roller makes its way into the receptacle pocket, and the lowering movement is stopped. The door frame is fully closed in this state. Thanks to the receptacle pocket, the drop-down seal remains in the closed position without further blocking installations being necessary. The roller is guided out of the receptacle pocket again only when the door leaf is opened, this enabling automatic lifting of the sealing strip. This assembly has the disadvantage that a relatively great effort in terms of force by the user is necessary in the closing of the door, because the slide has to be lowered counter to the spring force and to the resistance of the lever that pushes onto the activation button. It is also disadvantageous that the automatic lifting of the slide in the opening of the door leads to the door being opened in a self-acting manner, the user thus not keeping full control in the opening action. A further disadvantage is that the slide in the running direction of the sliding door is disposed behind the drop-down seal such that the sealing strip has to be configured in a shortened manner and cannot completely seal in the region of the secondary closing edge. Furthermore, the terminal position permits little play such that a precise guiding of the door leaf and a precise positioning of all elements are mandatory.

Drop-down seals having an activation button that is activatable on the end side have proven successful in practice for pivotable door leafs. The force transmission ratio in the closing of the door leaf, without any further mechanisms, is already approximately 1:30, such that the activation button in the closing of the door leaf can be depressed without a noticeable effort in terms of force. The use of drop-down seals of this type in sliding doors is more problematic since the transmission of force onto the activation button is only 1:1 and thus more force has to be applied in order for the activation button to also be depressed in the closing of the door leaf.

SUMMARY OF THE INVENTION

It is therefore an object of the invention to achieve an improved sealing device for sliding doors.

The sealing device according to the invention of a sliding door having a displaceably mounted door leaf has a drop-down seal having a sealing strip and having a lowering mechanism for automatically lowering and lifting the sealing strip. The lowering herein is performed counter to a restoring force. The sealing device furthermore has an activation unit for activating the drop-down seal, wherein the activation unit has a bearing face that in the lowering direction is directed upward, as well as a bearing element which in the closing of the door leaf bears on said bearing face and, on account thereof, activates the drop-down seal.

The bearing element when bearing on said bearing face preferably activates the drop-down seal in that said bearing element activates the lowering mechanism.

The upwardly directed bearing face has the advantage that the weight of the door leaf in part or in full pushes onto the bearing element. A person closing the sliding door has to apply comparatively little or no additional force at all in order for the sealing strip to be lowered. Despite the drop-down seal, the sliding door can be closed without an increased effort in terms of force.

The bearing element is preferably connected or operatively connected to the lowering mechanism. Said bearing element per se can also be a component part of the lowering mechanism.

The bearing face and the bearing element are preferably configured such that a force that acts upward is maintained in the closing of the door leaf, said force being deflected in such a manner that said force acts on the activation mechanism.

The bearing face is preferably a run-up face, and the bearing element is preferably a run-up element which, bearing on the run-up face, runs along the latter. The run-up face is preferably a slide face, and the run-up element is preferably a slide element. Instead of a slide element, rollers or other suitable means for a relative movement between the bearing face and the bearing element can also be attached. Instead of a longitudinal movement, pure lifting of the bearing element can also be achieved by the bearing face in order for the drop-down seal, in particular the lowering mechanism, to be activated.

The assembly according to the invention is preferably disposed on the side of the secondary closing edge of the sliding door. However, said assembly according to the invention can also be disposed on the primary closing edge.

The activation unit, like the lowering mechanism, is preferably composed exclusively of mechanical means and preferably does not comprise any magnets and/or electric motors and/or sensors.

Since the bearing face in the sliding direction can be disposed beside the drop-down seal, and since an optional fastening of the bearing element at the end side is also possible in the upper region of the drop-down seal, the sealing strip can extend across the entire length of the door leaf, and said sealing strip can thus seal in an optimal manner.

The activation unit is preferably configured such that said activation unit holds the sealing strip in a lowered position without the restoring force influencing any sliding movement of the door leaf in the longitudinal direction of the sealing strip. On account thereof, no additional blocking mechanisms are necessary in order for the door leaf to be held in the closed position thereof.

Furthermore, the restoring force of the drop-down seal does not impede the complete closing of the sliding door. Due to the weight of sliding doors, many sliding doors have a brake mechanism which decelerates the closing movement of the door leaf shortly before the completely closed position is reached. It is prevented on account thereof that fingers or other parts of the body are excessively jammed. In preferred embodiments of the invention, this brake mechanism ought not to be influenced by the restoring force of the drop-down seal, or by the force required for lowering the seal, respectively. Additionally or alternatively, the intention is also that not more force is to be applied for closing the door. Therefore, the drop-down seal in these embodiments can be fully lowered already before the completely closed position is reached and be held in this position without any further effort in terms of external force. The sealing strip in the continuing closing movement does indeed scrape along the floor but only across a short distance.

This "zero force position" can be achieved in various ways. A position of the bearing element, or of the slide element, respectively, on the bearing face, or on the slide face, respectively, is preferably present, in which position the sealing strip is fully lowered and in which position the restoring force acting on the sealing strip is deflected in a direction perpendicular to the longitudinal direction of the sealing strip.

The bearing face, or the slide face, respectively, in the longitudinal direction of the drop-down seal preferably at least in part runs in an oblique direction, wherein said bearing face, or slide face, respectively, in the closing direction of the door leaf preferably runs from bottom to top. The gradient can be consistent or variable. The force that has to be applied for lowering the sealing strip can be set by means of the gradient. Force gear ratios for optimizing the force to be applied can thus be chosen.

The bearing face, or the slide face, respectively, preferably has a horizontally running portion on which the bearing element, or the slide element, respectively, bears so as to hold the sealing strip in the lowered position. The horizontal portion preferably adjoins the obliquely running portion. The door leaf can be completely closed in that the bearing element, or the slide element, respectively, first moves upward along the oblique face, herein lowering the sealing strip, and with the sealing strip lowered subsequently moves further along the horizontal face until the door leaf laterally contacts the door frame.

In one embodiment, the bearing face, or the slide face, respectively, has a depression in which the bearing element, or the slide element, respectively, bears so as to hold the sealing strip in the lowered position. The depression can be disposed in the oblique face or in the horizontal face, for example.

Alternatively or additionally, an oblique counter-face can also follow the horizontal face, said oblique counter-face being oblique in a manner identical or different to that of the oblique face. The bearing element in the lowered position of the sealing strip preferably reaches said oblique counter-face such that the restoring force acting on the sealing strip contributes toward the complete closing of the door leaf.

The bearing face and the bearing element preferably move in a mutually relative manner. The bearing face, or the slide face, respectively, is preferably disposed so as to be locationally fixed. This means that the bearing face is located in a positionally fixed manner in the door frame or in the wall, or on the floor, respectively, for example, that is to say that said bearing face is locationally fixed. The bearing element in the longitudinal direction is preferably movable, in particular displaceable, conjointly with the drop-down seal. Said bearing element is preferably fastened conjointly with said drop-down seal in or on the displaceable door leaf.

The bearing element is preferably fixedly connected to the drop-down seal, and the bearing face is configured in a module that is separate from the drop-down seal.

The upwardly directed bearing face enables a diversity of mechanisms for transmitting the trigger force to the activation mechanism of the drop-down seal. The same basic principle can thus be applied to the most varied types of drop-down seals.

The lowering mechanism of the drop-down seal in preferred embodiments has an activation button which activates the lowering mechanism by way of an influence of external force. The bearing element preferably acts indirectly or directly on this activation button and, on account thereof, lowers the sealing strip. Since many known drop-down seals have an activation button of this type, the activation unit according to the invention can be used with these known drop-down seals without the latter having to be significantly modified.

The drop-down seal in preferred embodiments has a housing in which the sealing strip is held so as to be liftable and lowerable. The activation button can project from said housing at the end side. In other embodiments, said activation button is flush with the end side of the housing, or is disposed so as to be set back. The set-back arrangement is the most preferable. Said activation button in the longitudinal direction of the sealing strip is preferably displaceable relative to the housing.

The bearing element preferably acts on said activation button at the end side, usually in that said bearing element indirectly or directly depresses said activation button in the closing of the door and releases said activation button again in the opening of the door. In other embodiments, the activation button is pulled in order for the sealing strip to be lowered.

The activation unit according to the invention can also be used with other types of lowering mechanisms, wherein the bearing element acts indirectly or directly on a suitable location of the drop-down seal.

In a first preferred embodiment according to the invention the bearing element is a first arm of a pivot module, wherein a second arm of the pivot module acts on the drop-down seal, preferably on the activation button.

In a second preferred embodiment according to the invention the bearing element is a lever arm.

The bearing element can also be part of another force transmission mechanism.

The sealing device according to the invention has the advantage that said sealing device is comparatively insensitive to tolerances both in the vertical as well as the horizontal direction. The assembly of the sealing device is thus comparatively simple and time-saving.

The claimed invention also comprises a sliding door having a displaceably mounted door leaf and a sealing device according to the invention.

The activation unit can also be configured as a retrofit set for existing drop-down seals. The claimed invention therefore furthermore relates to an activation unit of a sealing device according to the invention, wherein the activation unit has a first module which configures the bearing face, and has a second module which has a fastening element for fastening the drop-down seal in the door leaf as well as the bearing element that is disposed on the fastening element.

The drop-down seal is usually attached in a groove at an end side of the door leaf, is disposed on the end side, or is fastened laterally to the door leaf. The drop-down seal is usually located at the lower end of the door leaf and seals the latter in relation to the floor. However, it is also possible for the drop-down seal to be disposed at the top or laterally such that these edges are sealed.

The feature "directed upward in the lowering direction" used in this text and the claims indeed refers to the description of a drop-down seal that is disposed on the bottom and which seals in a downward manner, but also comprises all variants of the arrangement of the drop-down seal on other end faces of the door leaf. The same applies to features such as "downward", "upward", "lifting", "lowering", and similar. These alternative variants are thus also comprised by the patent claims and are within the claimed scope of protection.

Further embodiments are set forth in the dependent claims.

BRIEF DESCRIPTION OF THE DRAWINGS

Preferred embodiments of the invention will be described hereunder by means of the drawings which serve merely for explanation and are not to be interpreted as being restrictive. In the drawings.

DESCRIPTION OF PREFERRED EMBODIMENTS

Figure 1:
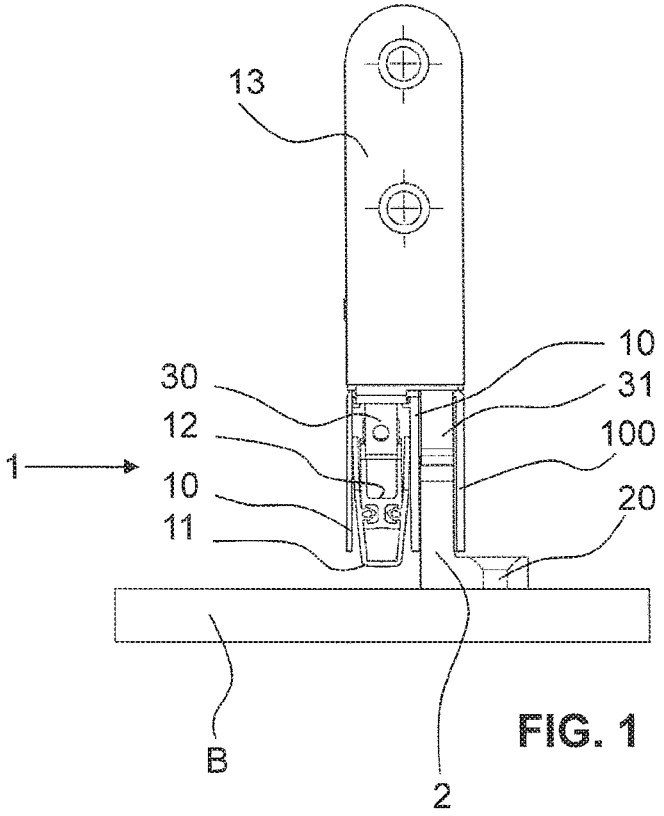
FIG. 1 shows a view of a sealing device according to the invention from the front, having a lifted sealing strip, according to a first embodiment.

FIGS. 1 to 10 show a first exemplary embodiment of a sealing device according to the invention.

The sealing device has a drop-down seal 1 of a known type, such as has been described at the outset, for example. The drop-down seal 1 has a housing rail 10 which by means of known means, here by means of a fastening bracket 13 that at the end side is push-fitted into a groove of the housing rail 10, is fastened in a lower groove of a displaceable sliding door leaf. Other types of fastenings, for example by means of lateral clamps, are likewise possible. The drop-down seal in the lifted state is preferably flush with the lower side of the displaceable door leaf.

As opposed to the prior art, the housing rail 10 is not only configured in a hat-shaped or U-shaped manner while configuring a first chamber that is open toward the bottom. Said housing rail 10 preferably has a second chamber which is delimited by an external additional wall 100. A sealing strip is held so as to be lowerable and liftable in the first chamber. To this end, a mechanical lowering mechanism of a known type that is likewise disposed in the chamber is present. Said mechanical lowering mechanism is not illustrated here, but is known from the prior art. Said mechanical lowering mechanism preferably has one or a plurality of leaf springs, wherein each of the leaf springs is fastened to the housing 10, to the sealing strip, as well as to a slide 15. The slide 15 is connected to an activation button 14 which is disposed on at least one side, preferably only on one side, of the housing rail 10. Said activation button 14 can project from the housing rail 10, be flush with the end side of the latter, or be disposed so as to be set back. If the activation button is disposed within the housing 10, said activation button can be displaced by compression or traction. However, said activation button can also be contacted and moved for example by way of a lateral or upper window 101 in the housing rail 10. Trigger mechanisms as an alternative to the activation button can likewise be used in the sealing device according to the invention.

The sealing strip preferably has a support rail 12 and an elastomeric sealing profile 11 that is fastened to said support rail 12. The housing rail 10 and the support rail 12 are preferably composed of aluminum or another suitable metal. The sealing profile 11 is preferably made from rubber or silicone.

Figure 6:
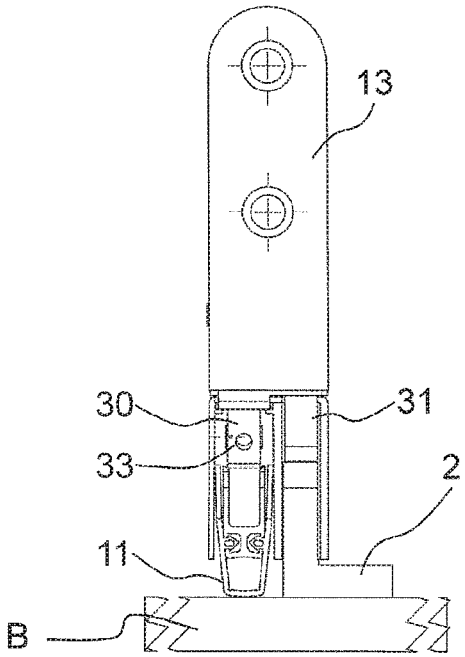
FIG. 6 shows a view of a sealing device according to the invention from the front, having a lowered sealing strip, according to FIG. 1.
Figure 7:
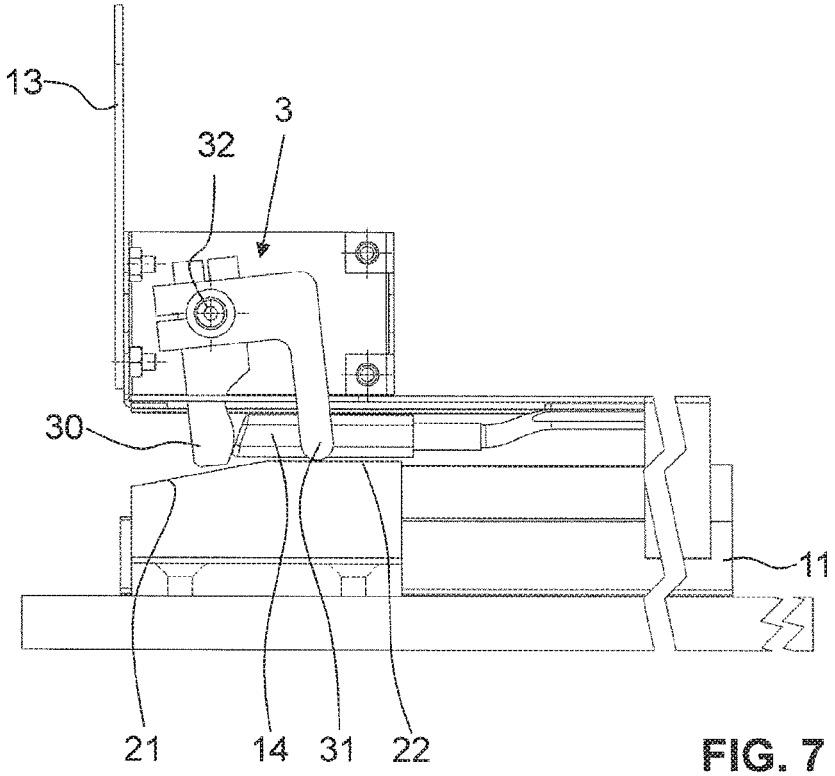
FIG. 7 shows a longitudinal section through the sealing device according to FIG. 7, having a lowered sealing strip.
Figure 8:
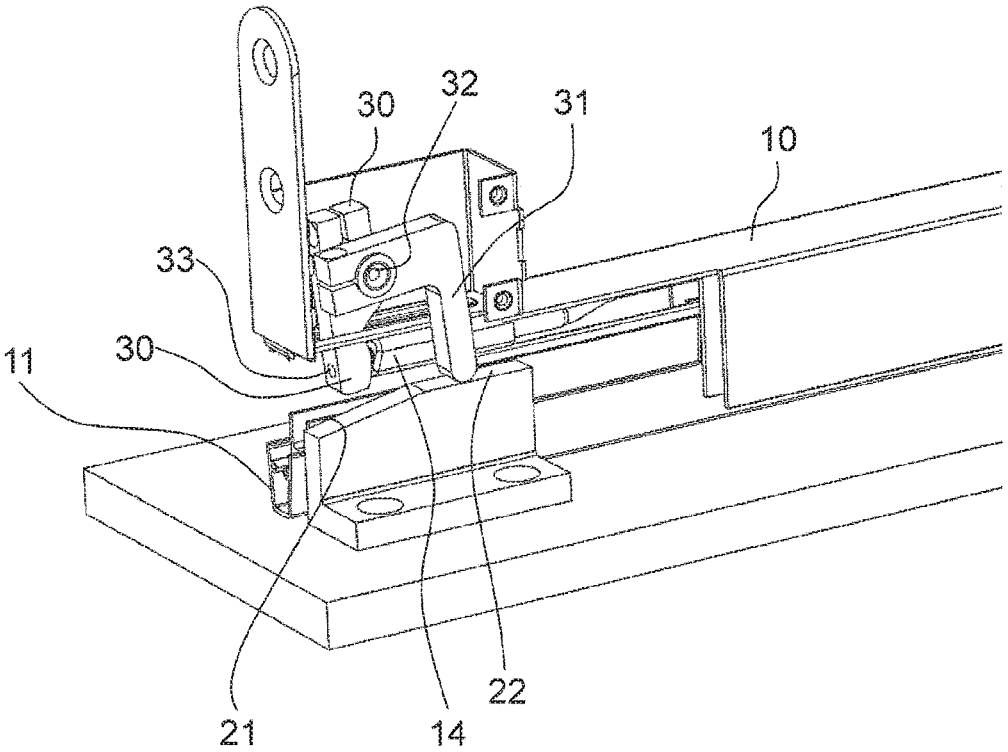
FIG. 8 shows a perspective illustration of the sealing device according to FIG. 7.
Figure 9:
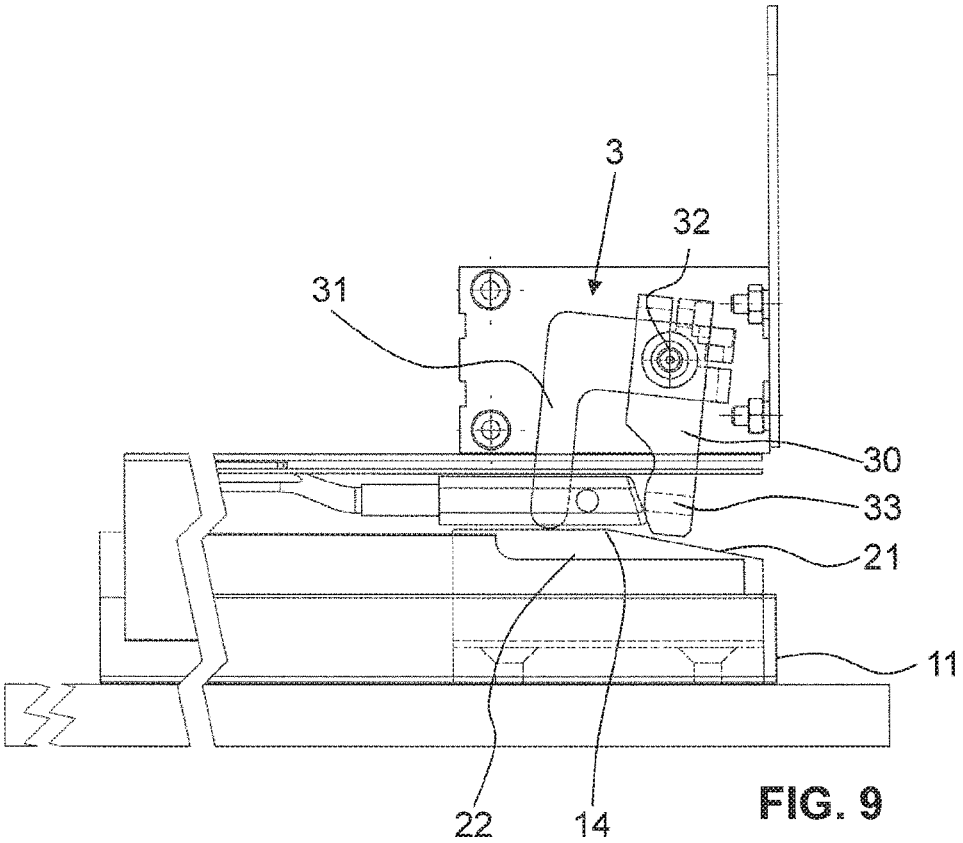
FIG. 9 shows the longitudinal section through the sealing device according to FIG. 7, as seen from the opposite side.
Figure 10:
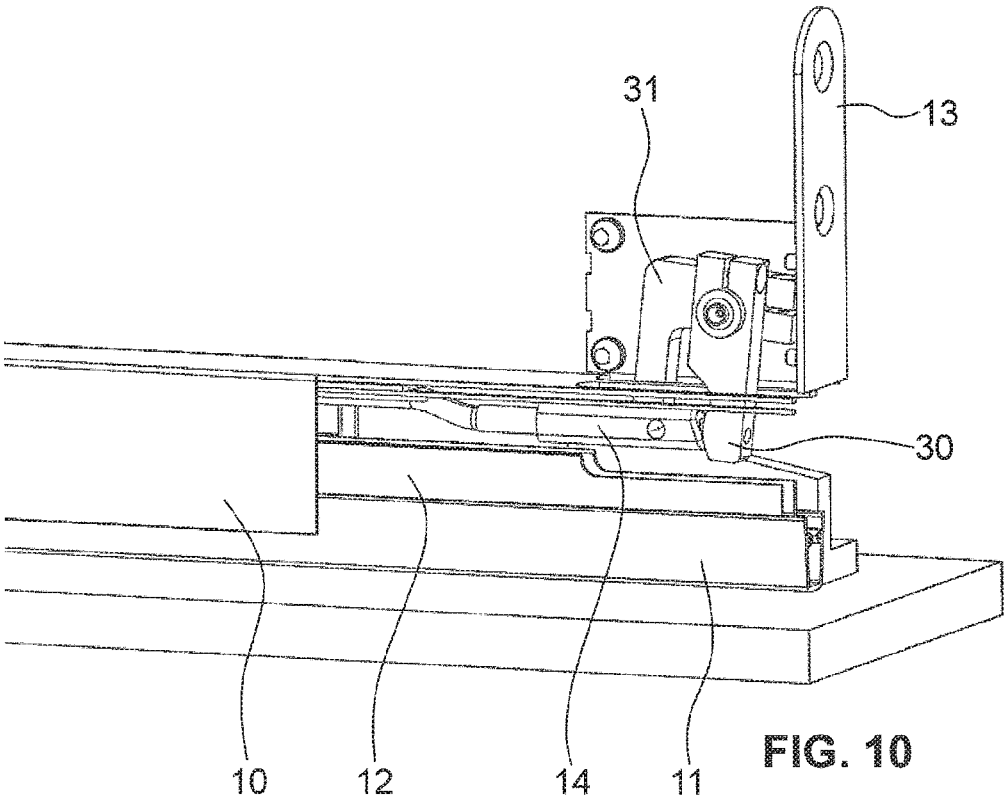
FIG. 10 shows a perspective illustration of the sealing device according to FIG. 9.
Figure 11:
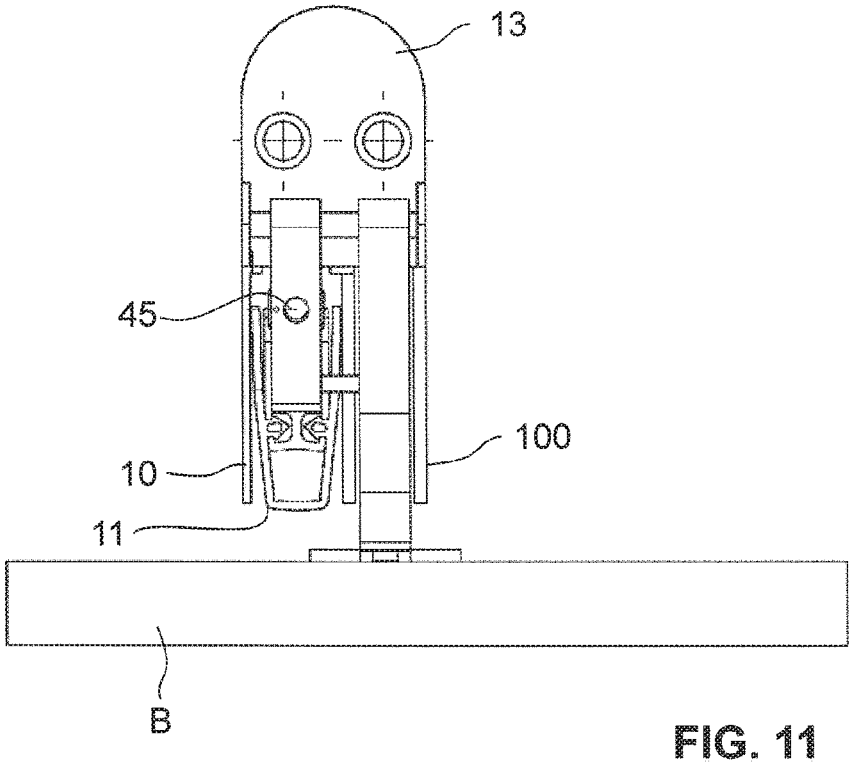
FIG. 11 shows a view of a sealing device according to the invention from the front, having a lifted sealing strip, according to a second embodiment.
Figure 12:
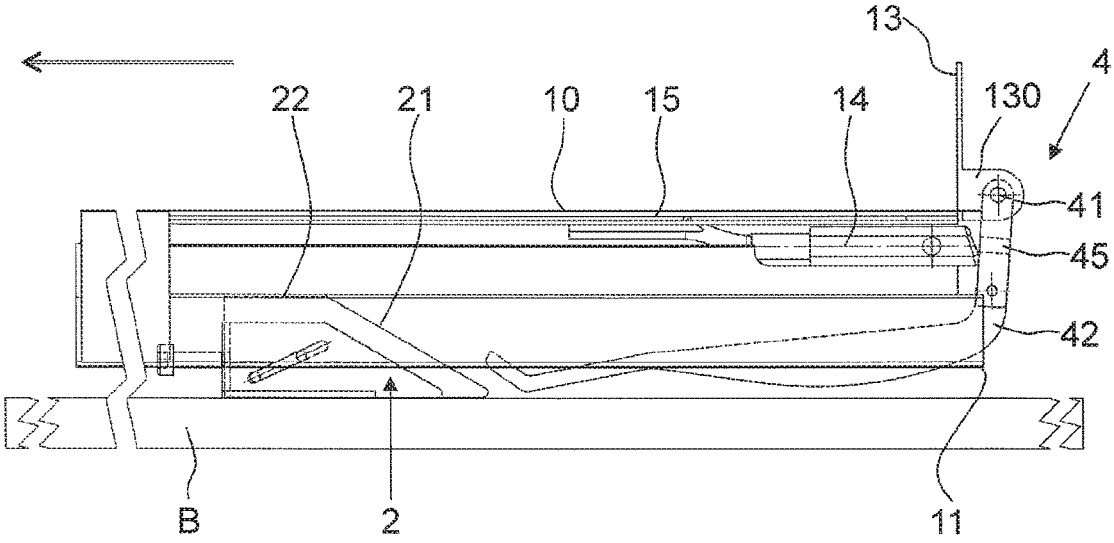
FIG. 12 shows a longitudinal section through the sealing device according to FIG. 11, having a lifted sealing strip, from a first side.
Figure 13:
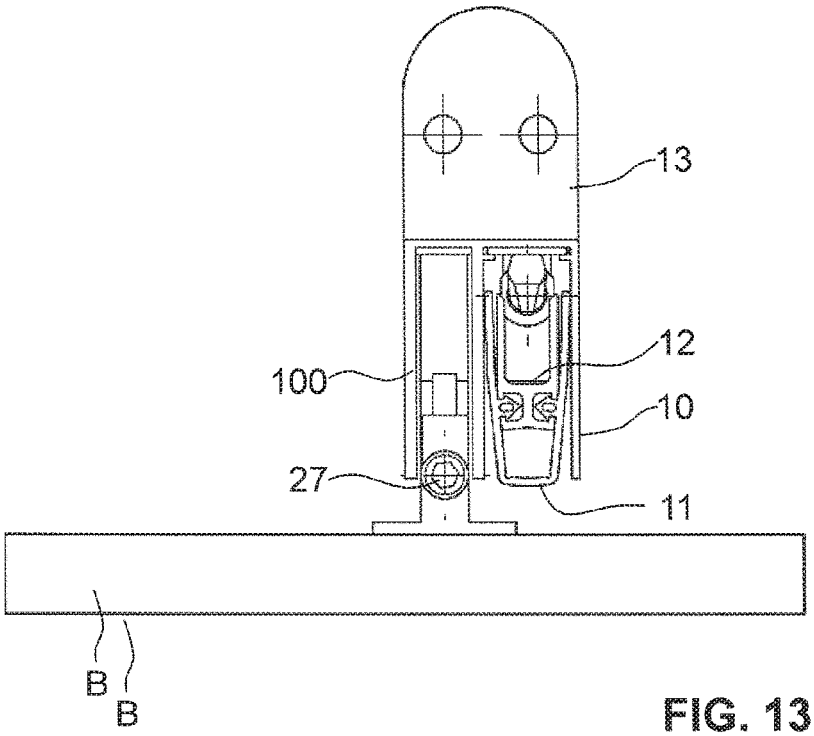
FIG. 13 shows a view of a sealing device according to the invention from the rear, having a lifted sealing strip, according to FIG. 11.
Figure 14:
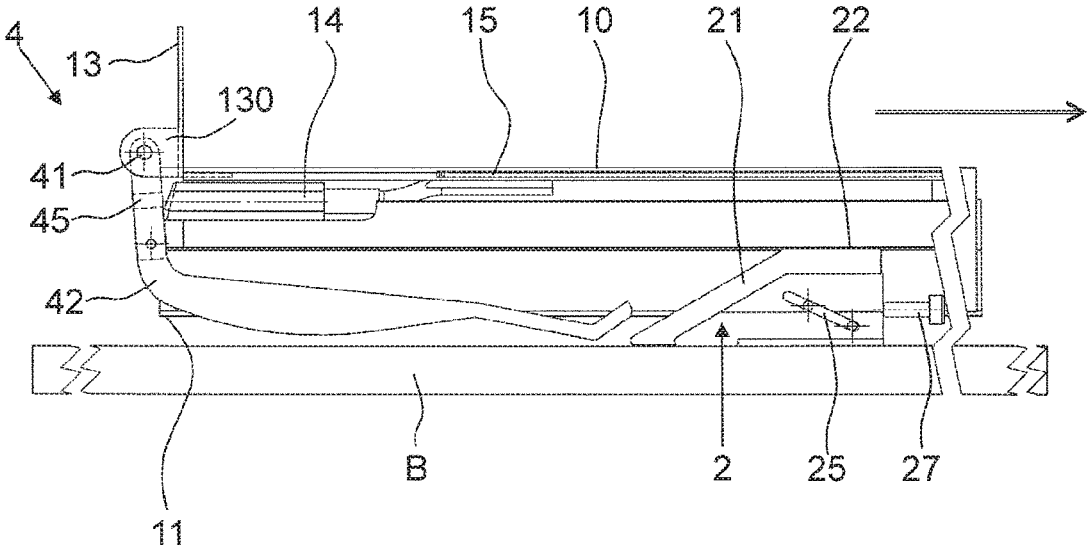
FIG. 14 shows the longitudinal section according to FIG. 12, from the opposite side.
Figure 15:
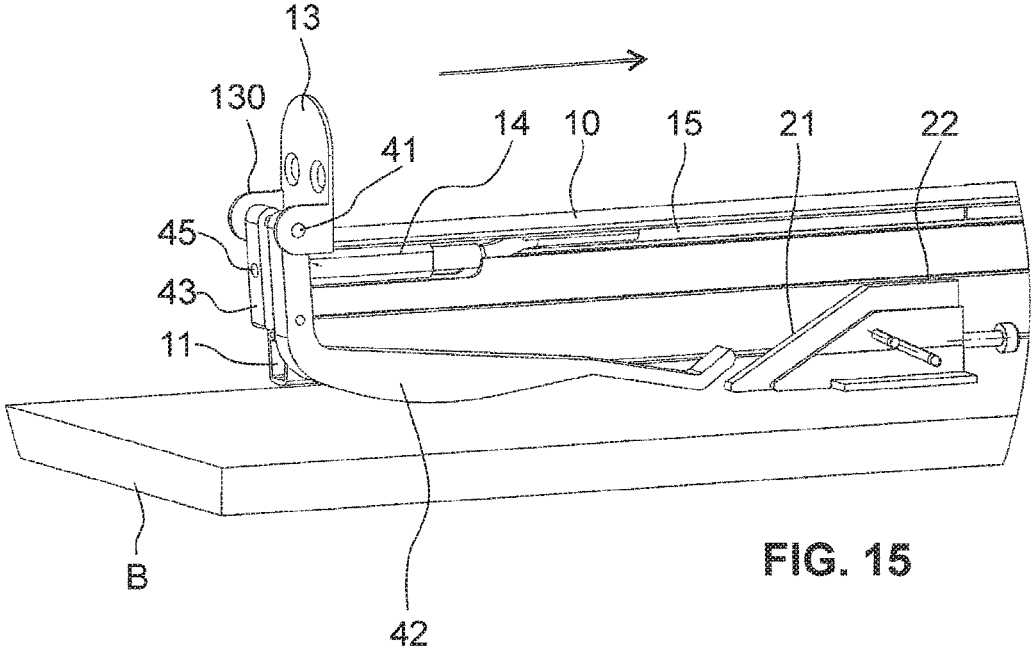
FIG. 15 shows a perspective illustration of the sealing device according to FIG. 14.
Figure 16:
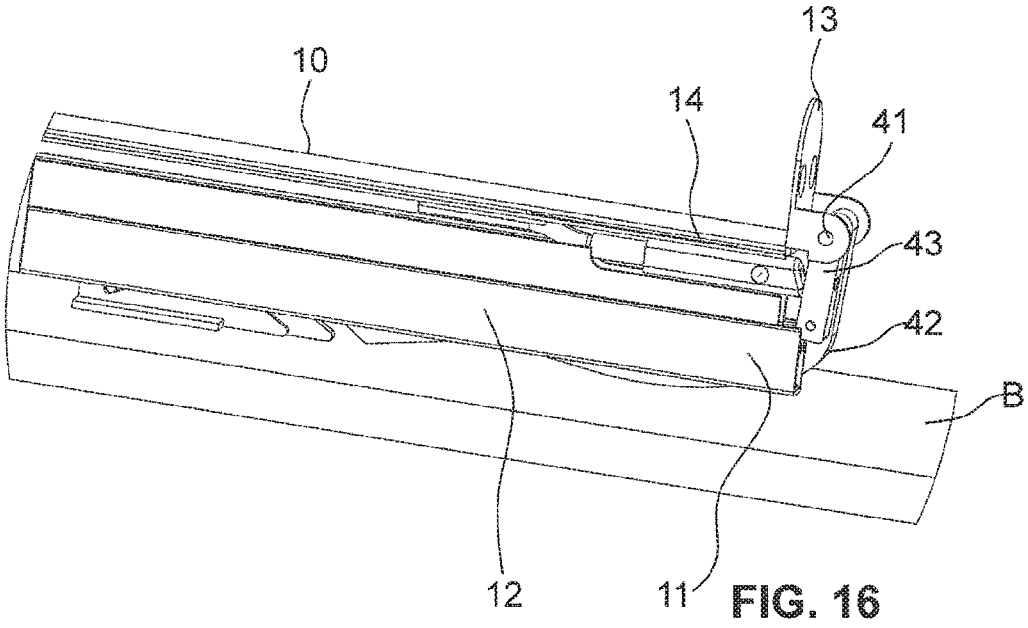
FIG. 16 shows a perspective illustration of the sealing device according to FIG. 12.
Figure 17:
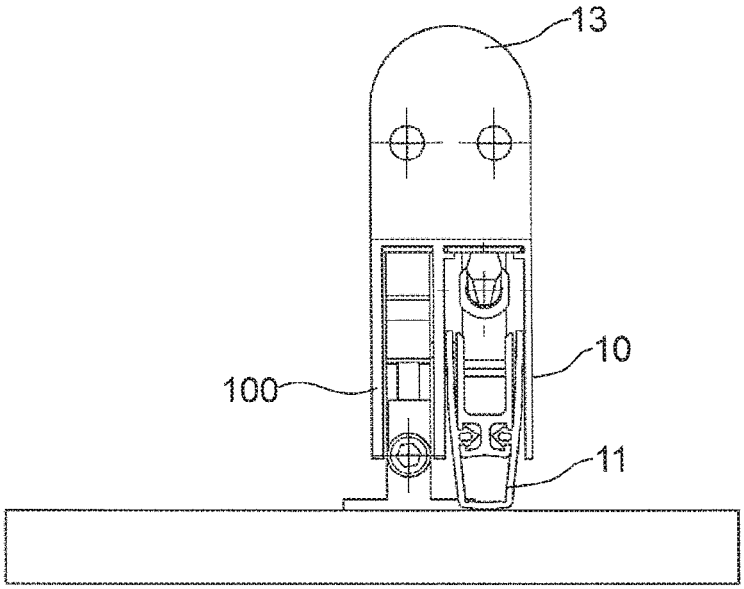
FIG. 17 shows a view of a sealing device according to the invention from the rear, having a lowered sealing strip, according to FIG. 11.
Figure 18:
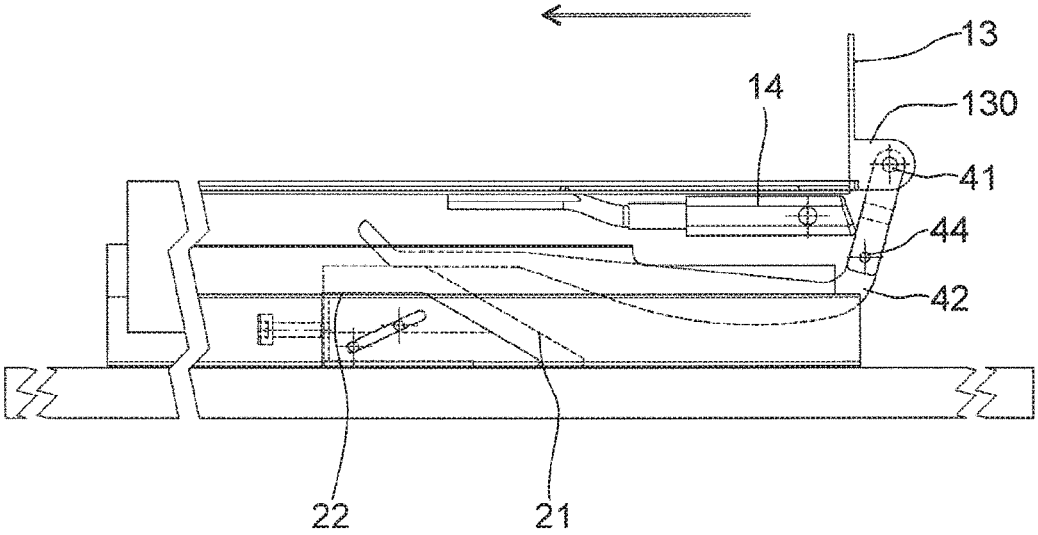
FIG. 18 shows a longitudinal section through the sealing device according to FIG. 17, having a lowered sealing strip, from a first side.
Figure 19:
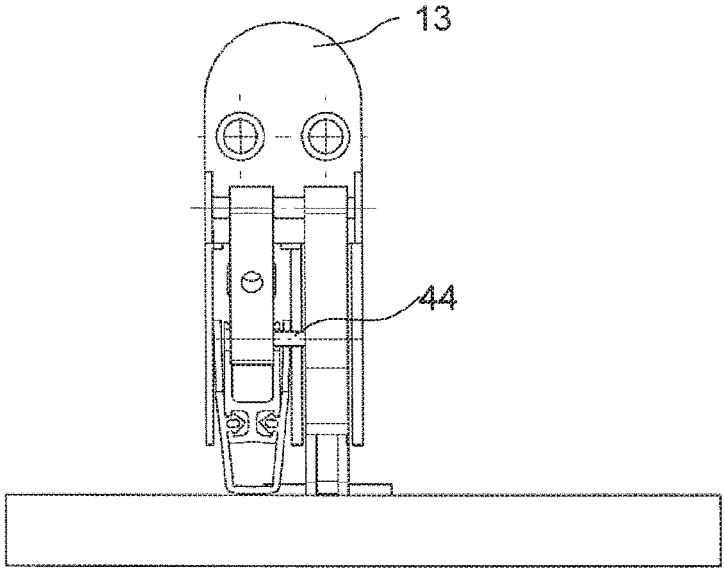
FIG. 19 shows a view of a sealing device according to the invention from the front, having a lowered sealing strip, according to FIG. 11.
Figure 20:
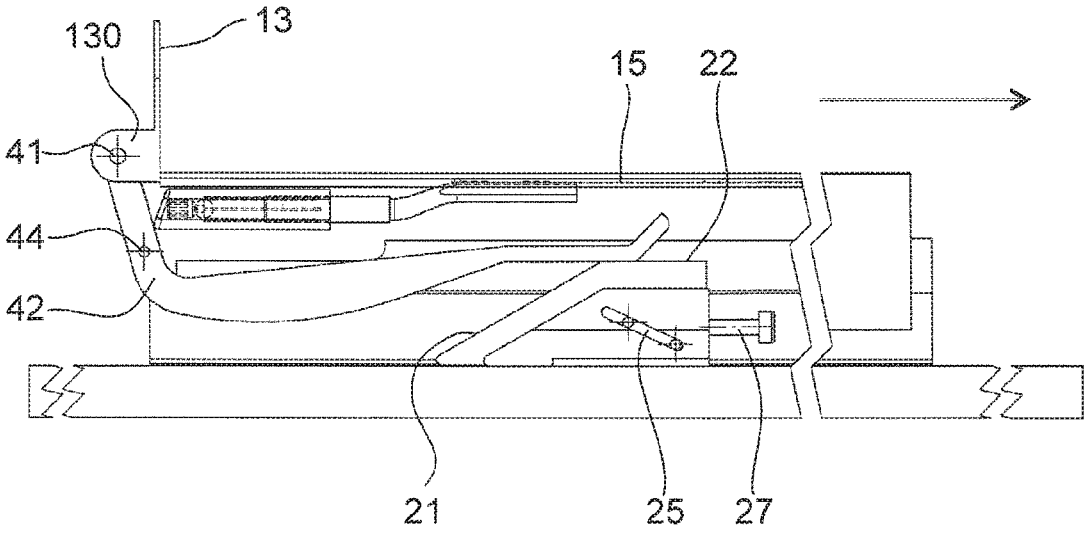
FIG. 20 shows the longitudinal section according to FIG. 18, from the opposite side.

As can be readily seen in a comparison of FIGS. 1 and 6, the sealing profile 11 in the lowered state of the sealing strip seals the gap between the lower side of the door leaf and a floor B.

The sealing device according to the invention furthermore comprises an activation unit for activating the activation mechanism of the drop-down seal. The activation unit preferably acts on the activation button 14 of the drop-down seal in that said activation unit preferably depresses said activation button 14. Depending on the activation unit and on the lowering mechanism, said activation unit can also displace or extract the button in order for the sealing strip to be lowered.

Figure 2:
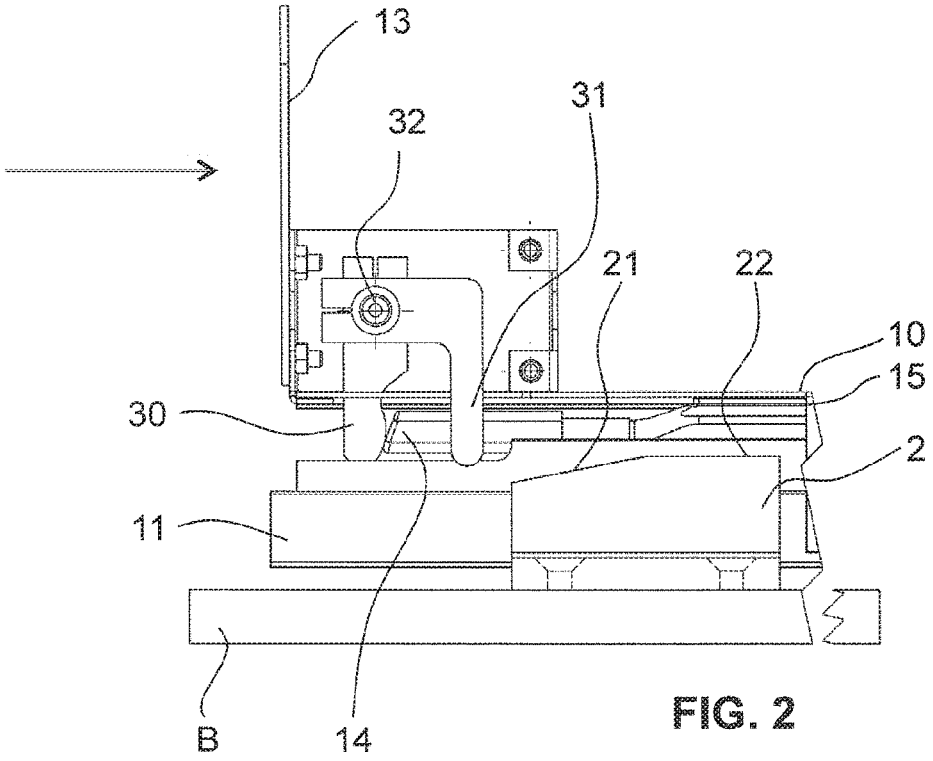
FIG. 2 shows a longitudinal section through the sealing device according to FIG. 1, having a lifted sealing strip.

As can be seen in FIG. 2, the activation unit has a bearing module 2. This bearing module 2 is disposed beside the drop-down seal 1. Said bearing module is fastened in a locationally fixed manner on the floor B or to the door frame. The through bores existing therefor are provided with the reference sign 20. The bearing module 2 is located beside the drop-down seal 1, wherein the latter in the displacement of the door leaf is received into the second chamber formed by the additional wall 100 of the housing rail 10. This can be readily seen in FIGS. 1, 3, and 6.

The bearing module 2 in this example is configured as an angular element, wherein said bearing module 2 by way of one leg is fastened to the floor or the door frame, the second leg protruding upward. The bearing module 2 has an upwardly directed bearing face. The bearing face in this case is configured as an oblique face 21 and a horizontal face 22 that is adjacent to the latter. The bearing face preferably forms a slide face, wherein the surface structures of the oblique face 21 and of the horizontal face 22 enable sliding, for example by way of a material selection and/or by way of a correspondingly fine surface machining and/or by way of a coating. The bearing module 2 is preferably composed of plastics material, metal, or of a coated metal or wood.

The activation unit furthermore comprises a force transmission module having a bearing element. The force transmission module in this exemplary embodiment is a pivot module 3 having a pivot arm 30 and a follower 31. This can be readily seen in FIGS. 2 to 5 as well as 7 to 10. The pivot arm 30 and the follower 31 in the transverse direction of the drop-down seal are disposed beside one another and are directed downward. Said pivot arm 30 and said follower 31 are conjointly interconnected by way of a pivot axle 32 and are conjointly pivotable in relation to the housing rail 10. The pivot axle 32 is preferably disposed in a module housing or module frame which is preferably fixedly connected to the fastening bracket 13. The pivot axle 32 is preferably located laterally above the housing rail 10. Said housing rail 10 in the region of the second chamber has an opening 101 which are penetrated by the entrainment element 31 and by the pivot arm 30, as can be readily seen in FIG. 5.

The pivot module 3 is preferably disposed so as to be flush with the housing rail 10 or so as to be set back from the latter. The activation button 14 is set back accordingly. On account thereof, the full width of the door leaf can be sealed by means of the drop-down seal.

Figure 3:
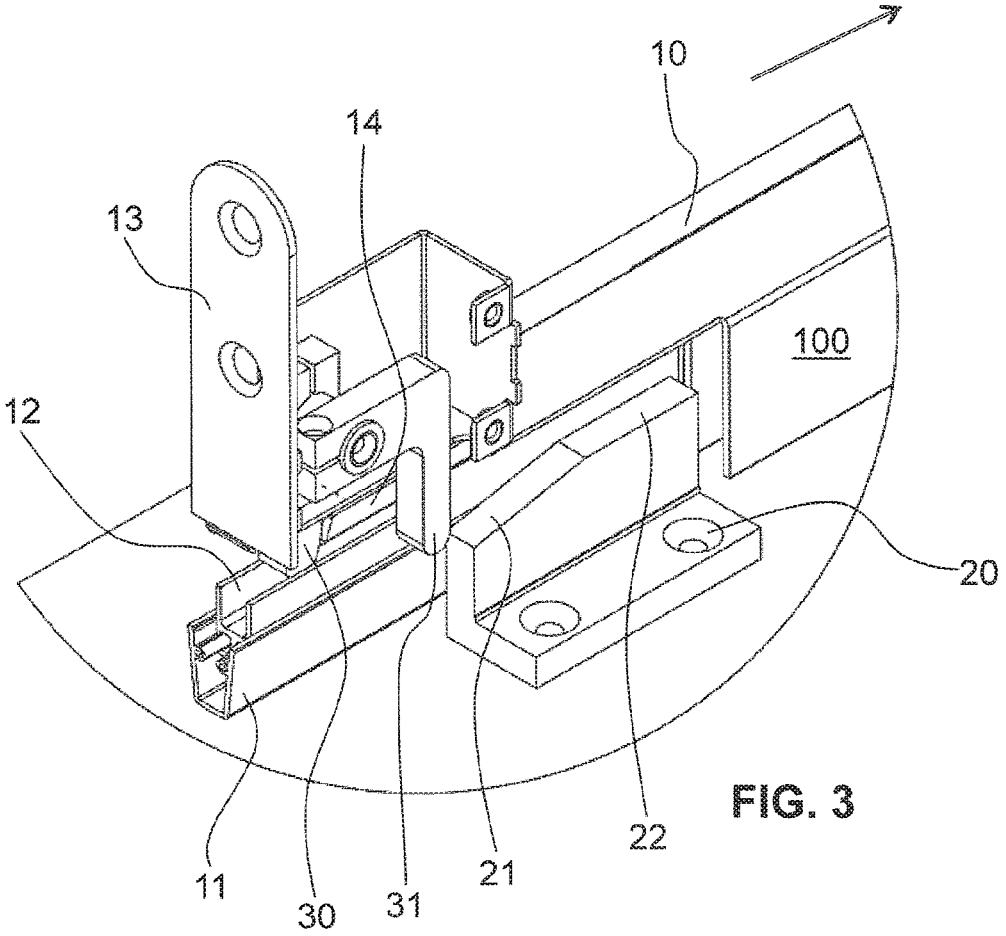
FIG. 3 shows a perspective illustration of the sealing device according to FIG. 2.
Figure 4:
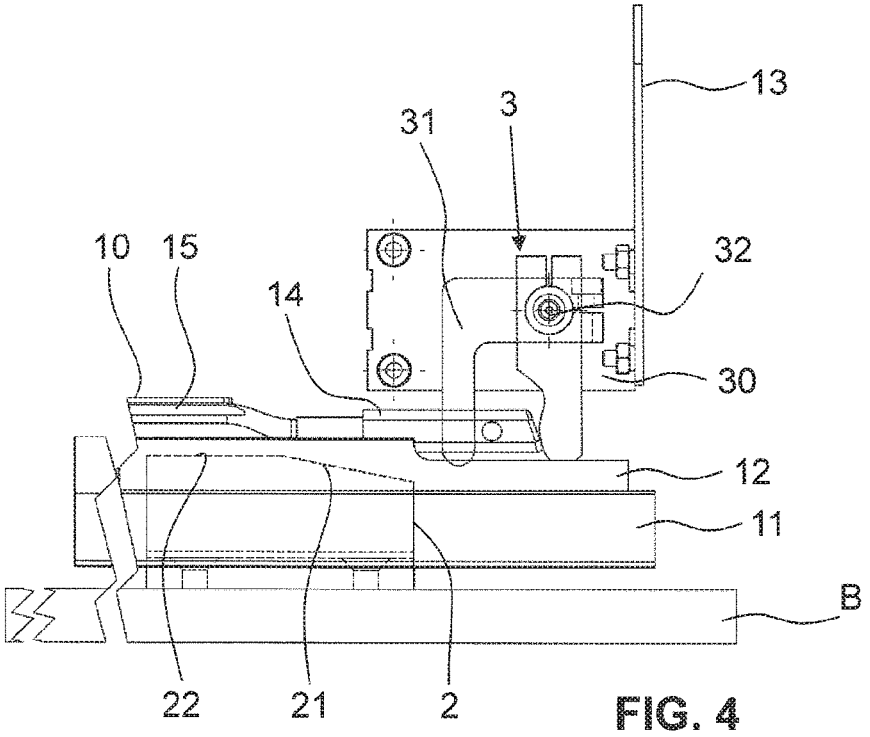
FIG. 4 shows the longitudinal section through the sealing device according to FIG. 2, as seen from the opposite side.
Figure 5:
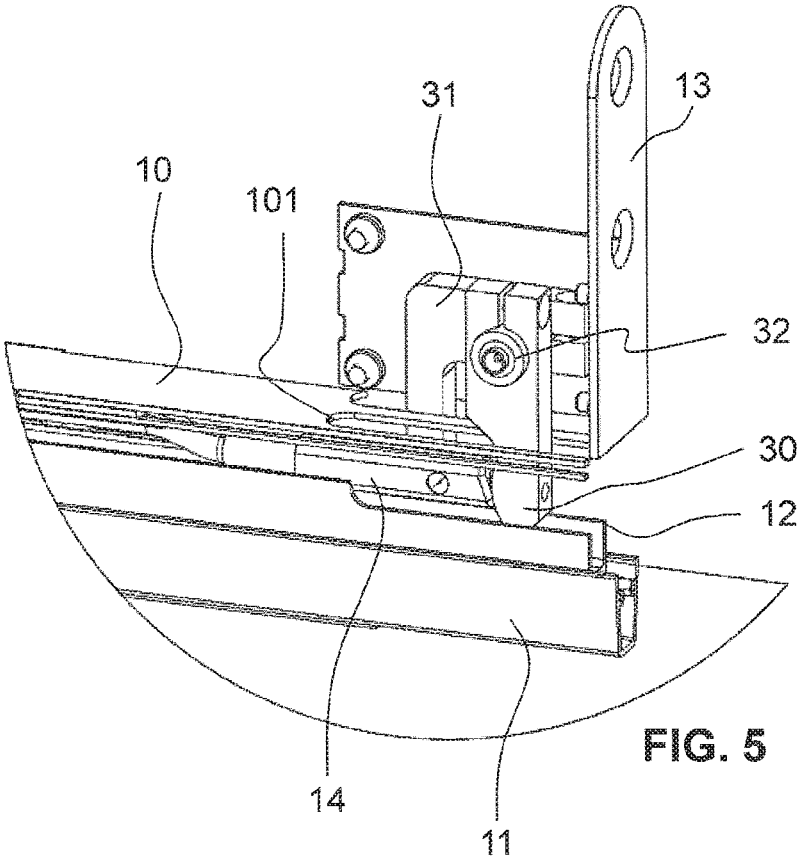
FIG. 5 shows a perspective illustration of the sealing device according to FIG. 4.

The closing direction of the door leaf is indicated by an arrow in FIGS. 2 and 3. As soon as the door leaf is pushed in the direction of these arrows into the region of the bearing module 2, the follower 31 sits on the bearing face of the bearing module 2. Said follower 31 thus forms a bearing element. Said follower 31 is preferably configured as a slide element which in the closing of the door leaf slides along the oblique face 21 upward to the horizontal face 22. The closing movement thus lifts the follower 31. The pivot movement of the pivot module 3 associated therewith moves the pivot arm 30 to the rear. On account thereof, said pivot arm 30 pushes onto the activation button 14 and activates the drop-down seal 1.

The follower 31 in FIGS. 2 to 5 is still located ahead of the bearing module 2. The activation button 14 is not stressed, and the sealing strip 11, 12 is lifted.

The follower 31 in FIGS. 7 to 10 has moved up the oblique face 21 and has reached the horizontal face 22. In sliding upward, the sealing strip 11, 12 has been lowered in that the depressed activation button 14 has displaced the slide 15 and the latter has tensioned the leaf springs and lowered the sealing strip 11, 12. By reaching the horizontal face 22, the maximum lowering of the sealing strip 11, 12 has also been reached. Said sealing strip 11, 12 now bears in a sealing manner on the floor B. Said sealing strip 11, 12 herein is spring-loaded. However, the restoring force bearing on said sealing strip 11, 12 is diverted by way of the activation button 14 to the pivot module 3, more specifically to the follower 31. Since said follower 31 sits perpendicularly on the horizontal face 22, the sealing strip 11, 12 is held in the lowered state without any further blocking means. The door leaf can continue to be closed in the direction of the arrow in that the follower 31 is displaced along the horizontal face 22, without the restoring force of the sealing strip having to be overcome to this end. The displacement of the follower 31 is preferably a slide movement.

As an alternative to the slide faces on the follower 31 and the bearing module 2, rollers or other suitable means can also be attached to the follower 31 and/or the bearing module 2, so as to enable an ideally friction-free relative movement.

If the door leaf is opened again in the direction counter to the arrow, the follower 31 slides down the oblique face 21. The pivot arm 30 is pivoted back and releases the activation button again. The leaf springs are de-stressed and the sealing strip 11, 12 is automatically lifted again.

The pivot arm 30 in the longitudinal direction of the sealing strip is located ahead of the activation button 14. The activation button 14 is usually provided with a thread so that the former can still be set on site; that is to say that the basic position of said activation button 14 relative to the support rail 12 and to the housing rail 10 in the longitudinal direction can be set. In order for this to be possible also in the use of the module according to the invention, the pivot arm 30 has a through opening 30. The latter can be penetrated by a suitable tool such as, for example, an Allen key or a screwdriver, so as to modify the activation button 14 in terms of the basic position thereof.

A second exemplary embodiment is illustrated in FIGS. 11 to 24. Identical parts are identified by the same reference signs as in the first exemplary embodiment and are not described once again. The above applies in an analogous manner. Instead of a pivot module 3, a lever module 4 is present here, said lever module 4 likewise being disposed again in the second chamber of the housing rail 10 and being operatively connected to the bearing module 2 as soon as the displaceable door leaf in the closing movement has reached said bearing module 2.

The lever module 4 in this example is pivotably disposed on the fastening bracket 13 which to this end has two fastening cams 130 projecting from the end side. The pivot axle of the lever module 4 is provided with the reference sign 41. The lever module 4 in the exemplary embodiment illustrated projects from the fastening bracket 13. Alternative arrangements in which also the lever module 4 is flush with the end side of the housing rail 10 or even is disposed so as to be set back are possible.

The lever module 4 has a pivot lever 42 which again runs beside the drop-down seal 1 and so as to be parallel with the longitudinal direction of said drop-down seal 1. An activation lever 43 is held so as to be pivotable about the same pivot axle 41, but so as to be ahead of the drop-down seal 1 at the end side, parallel to the pivot lever 42. A connecting bolt 44 connects the activation lever 43 to the pivot lever 42 such that said activation lever 43 and the pivot lever 42 are pivotable only conjointly and in the same direction. The activation lever 43 in turn has a through opening 45 in order for the activation button 14 to be adjusted.

Figure 21:
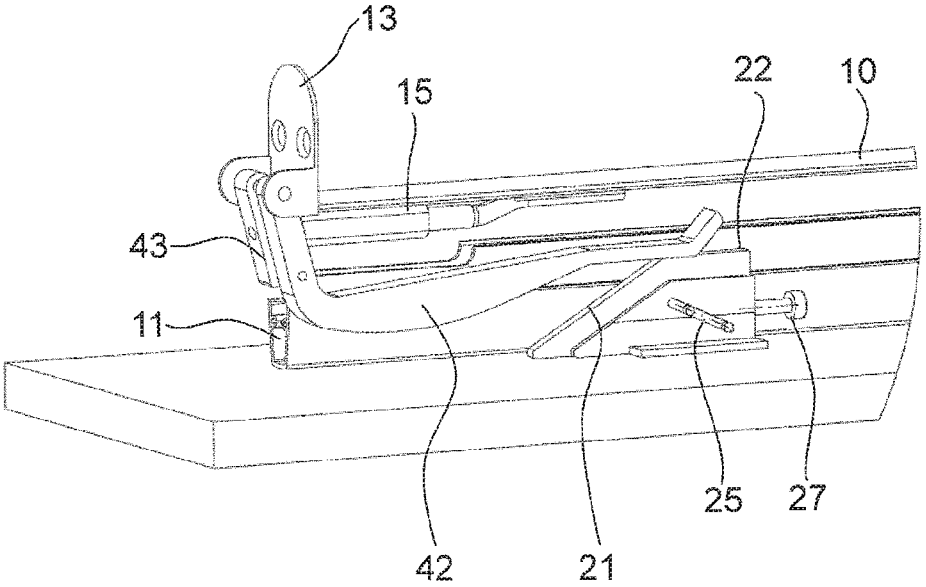
FIG. 21 shows a perspective illustration of the sealing device according to FIG. 20.
Figure 22:
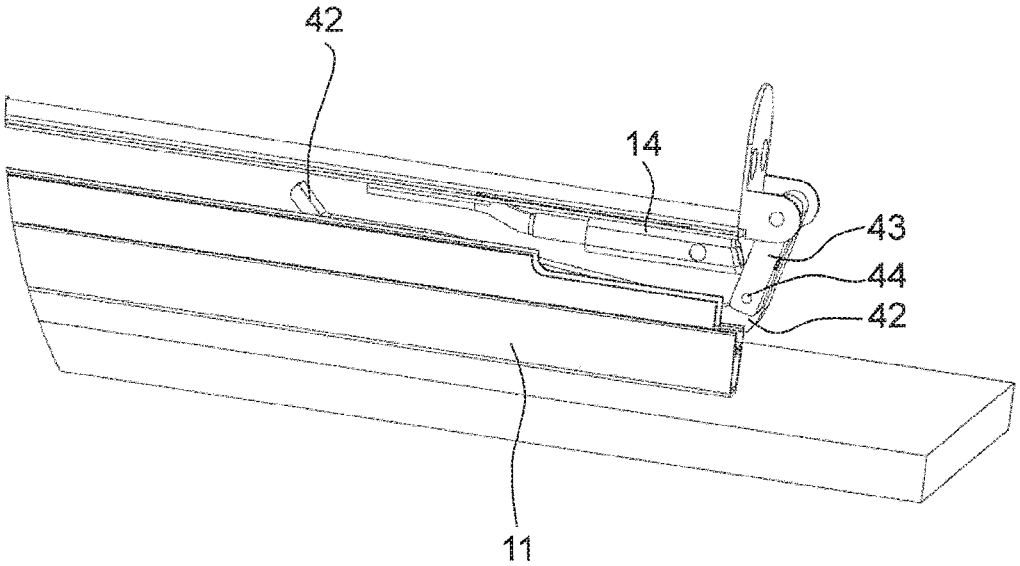
FIG. 22 shows a perspective illustration of the sealing device according to FIG. 18.

The pivot lever 42 in the closing of the door leaf slides upward along the oblique face 21. This can be readily seen when viewing FIGS. 15 and 21 together. Once the horizontal face 22 has been reached, as is illustrated in FIG. 21, said pivot lever 42 preferably bears flat on said surface. The pivot lever 42 is shaped accordingly. Said pivot lever 42 forms the bearing element. Said pivot lever 42 in this movement is pivoted about the pivot axle 41. The activation lever 43 is pushed accordingly against the activation button 14, and the sealing strip 11, 12 is lowered.

The restoring force acting on the sealing strip 11, 12 also in this example is compensated for by the pivot lever 42 bearing on the bearing module 2, and the door leaf in the case of a fully lowered sealing strip 11, 12 can continue to be closed.

The pivot lever 42 in the opening of the door leaf slides down the oblique face 21 again and releases the activation button 14 such that the sealing strip 11, 12 is lifted again.

The gradient of the oblique face 21 again influences the gear ratio and the force required for lowering the seal.

The bearing module 2 illustrated in this exemplary embodiment is configured so as to be capable of setting. The same module can also be used in the first exemplary embodiment described here or in other exemplary embodiments of the invention.

Figure 23:
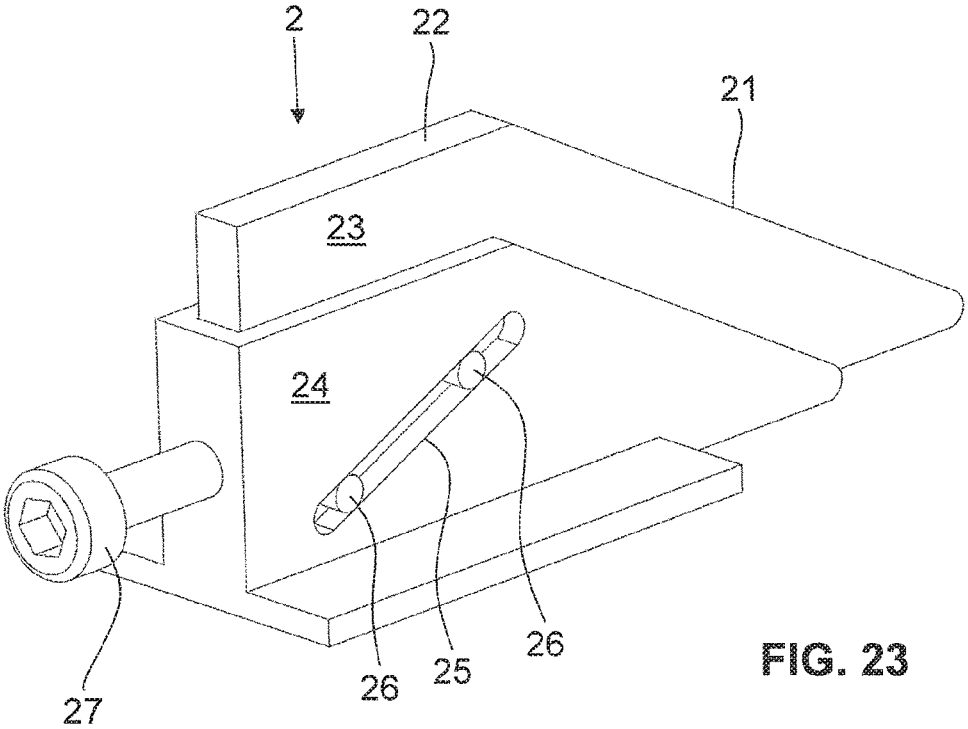
FIG. 23 shows a perspective illustration of the slide module in a first position.
Figure 24:
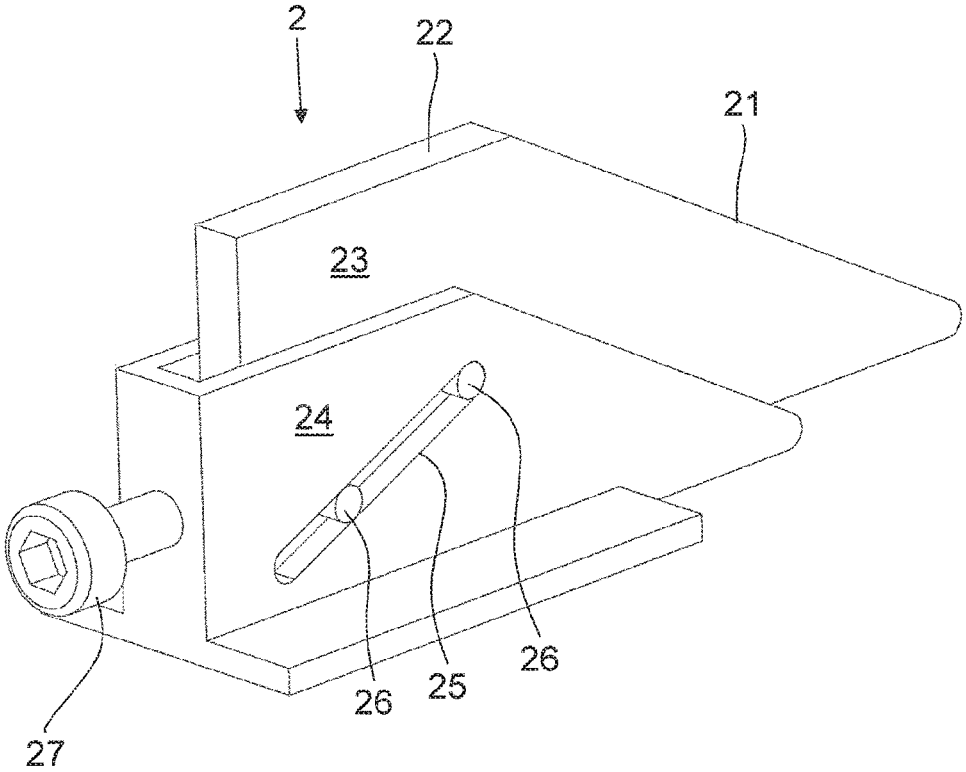
FIG. 24 shows a perspective illustration of the slide module according to FIG. 23, in a second position.
Figure 25:
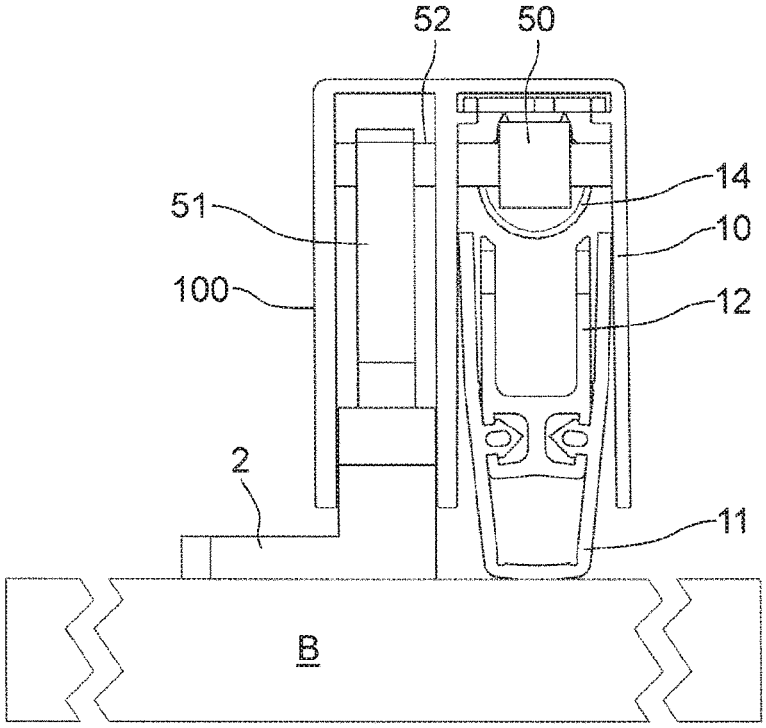
FIG. 25 shows a view of a sealing device according to the invention from the front, having a lowered sealing strip, according to a third embodiment.
Figure 26:
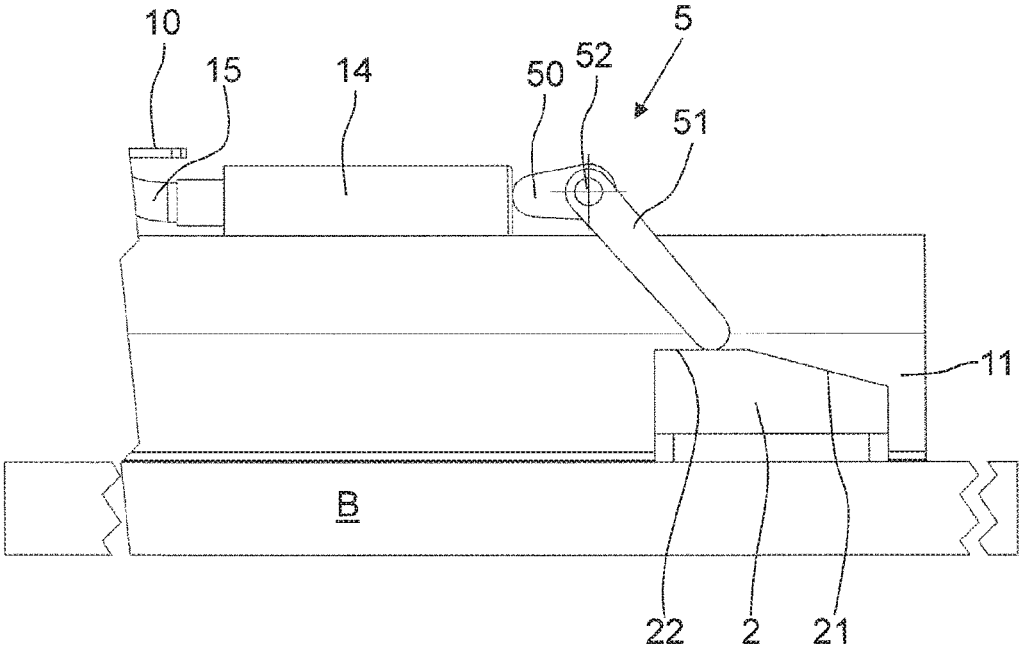
FIG. 26 shows a longitudinal section through the sealing device according to FIG. 25.
Figure 27:
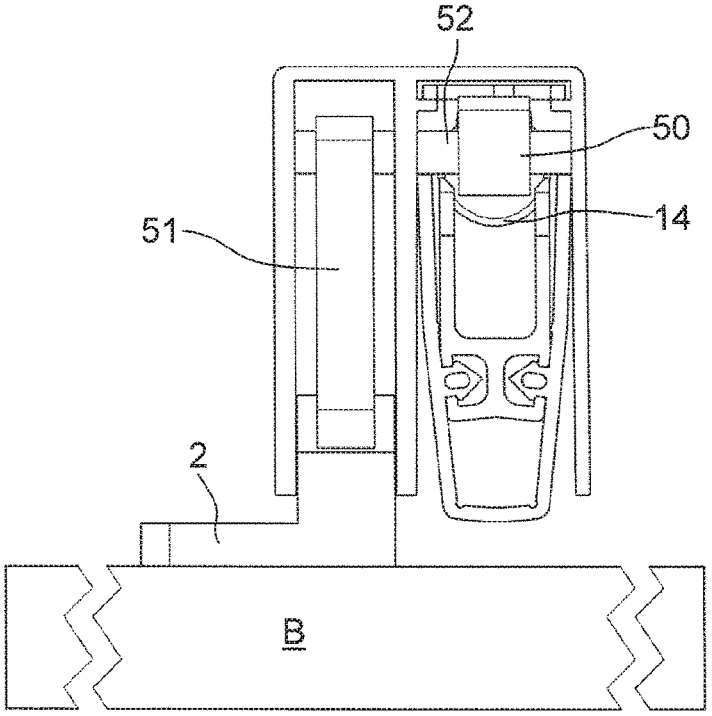
FIG. 27 shows a view of the sealing device according to FIG. 25 from the front, having a lifted sealing strip.
Figure 28:
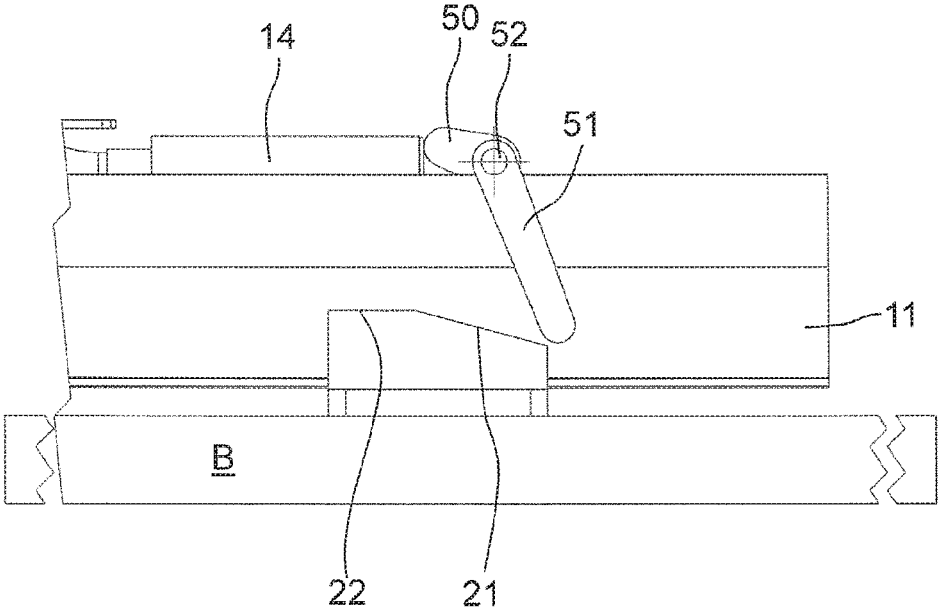
FIG. 28 shows a longitudinal section through the sealing device according to FIG. 27.

As can be readily seen in particular in FIGS. 23 and 24, said module has a locationally fixed module frame 24 in which a module body 23 is displaceably held. The module body 23 configures the oblique face 21 and the horizontal face 22. The module frame 24 has a guide slot 25 on both sides, said guide slot 25 on each side being penetrated by two guide pins 26. The guide pins 26 are fixedly connected to the module body 23. The guide slot 25 runs obliquely upward, having a gradient that is counter to that of the oblique face 21. An adjustment screw 27 penetrates the module frame 24 on that side that is opposite the oblique face 21 and pushes onto the module body 23. On account thereof, the module body 23 can be displaced in the vertical and horizontal directions. This enables the stroke of the sealing strip 11, 12 to be set such that said sealing strip 11, 12 is pushed onto the floor B in an optimal manner. Other types of setting capabilities of the activation unit in terms of stroke and distance are possible.

A further exemplary embodiment of a sealing device according to the invention is illustrated in FIGS. 25 to 28. Identical parts are provided with the same reference signs also here and are not repeated in detail any more.

The activation unit for activating the lowering mechanism of the drop-down seal again has the bearing module 2 which is disposed in a locationally fixed manner on the door frame or on the floor.

The activation unit furthermore comprises a pivot module 5 which again has a pivot arm 50 and a follower 51, said pivot arm 50 and said follower 51 being fixedly interconnected by way of a pivot axle 52 and thus being conjointly pivotable. As opposed to the exemplary embodiment according to FIGS. 1 to 10, the follower 51 and the pivot arm 50 however no longer run in a mutually parallel manner but are at an angle of 90° or more, but smaller than 180°. The angle is preferably approx. 120°. Furthermore, the pivot arm 50 and the follower are preferably configured in a straight line. In the first example, only the pivot arm 30 is configured in a straight line, and the follower 31 preferably configures an angle, in particular a right angle.

The pivot arm 50 according to the third exemplary embodiment is preferably configured so as to be substantially shorter than the follower 51.

The pivot axle 52 can be disposed within the housing rail 10 and be fastened to the latter on both sides. Other types of fastenings are possible.

As already in the first exemplary embodiment, the entrainment element 51 in the closing of the door leaf slides upward along the bearing module 2 and is deflected. On account thereof, the pivot arm 50 is also deflected and pushes onto the activation button 14. Said activation button 14 moves to the rear, and the sealing strip 11, 12 is lowered.

The weight of the door leaf is also here used again as the trigger force. The restoring force of the drop-down seal in the lowered state is again deflected thanks to the entrainment element 51 bearing on the bearing module 2. The restoring force of the lowered seal can thus no longer urge the door leaf open. No additional force is required in order for the door leaf to be held in the closed position.

Two further variants of the bearing module 2 are illustrated in FIGS. 29 to 32. These variants can be used in the abovementioned exemplary embodiments or in other embodiments according to the teaching according to the invention.

Figure 29:
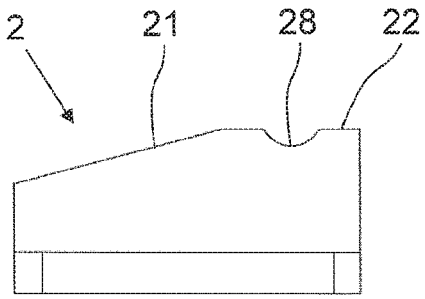
FIG. 29 shows a lateral view of a bearing module according to the invention in a second embodiment.
Figure 30:
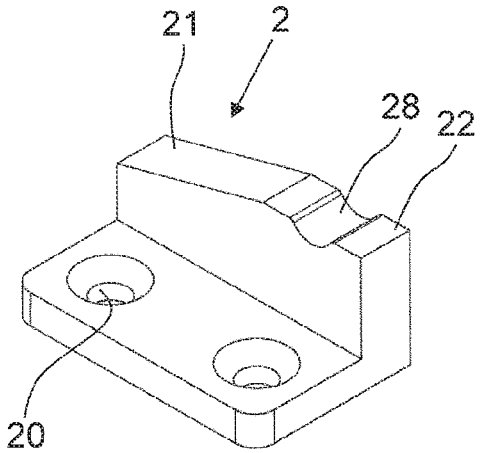
FIG. 30 shows a perspective illustration of the bearing module according to FIG. 29.

The horizontal face 22 of the bearing module 2 in the variant according to FIGS. 29 and 30 has a depression 28. The free end of the entrainment element 31, 51, or of the pivot lever 42, respectively, is held in said depression 28. The sealing strip 11, 12 in this position is again slightly lifted, but still seals completely. Said depression prevents any unintentional displacement of the entrainment element 31, 51, or of the pivot arm 42, respectively. On account of the slight lifting of the sealing strip 11, 12, the forces required for the continuing closing of the door leaf are furthermore minimized.

Figure 31:
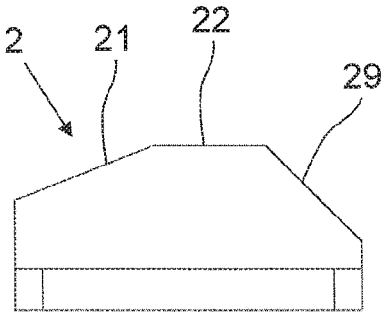
FIG. 31 shows a lateral view of a bearing module according to the invention in a third embodiment.
Figure 32:
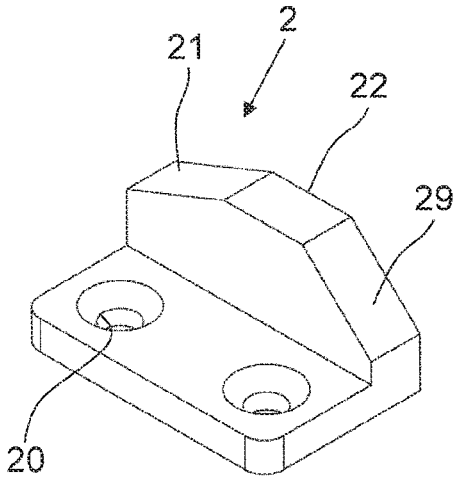
FIG. 32 shows a perspective illustration of the bearing module according to FIG. 30.

In the variant according to FIGS. 31 and 32, an oblique counter-face 29 is present so as to follow the horizontal face 22 in the closing direction of the door leaf. Said oblique counter-face 29 has the reverse gradient of the oblique face 21, that is to say that the gradient of the oblique counter-face 29 points downward. Said downward gradient can be dissimilar to the upward gradient of the oblique face 21. The oblique counter-face 29 is preferably configured so as to be steeper. When completely closing the door leaf, the entrainment element 31, 51, or the pivot lever 42, respectively, preferably makes its way up to the oblique counter-face 29 such that the sealing strip 11, 12 is again slightly lifted but nevertheless still seals in an adequate manner. However, said oblique counter-face 29 has the effect that the restoring force of the seal contributes toward the closing of the door leaf and actively holds the latter in its closed position.

The sealing device according to the invention enables the use of known drop-down seals in sliding doors, wherein said drop-down seals do not impede the closing movement of the sliding doors.

The invention claimed is:

1. A sealing device of a sliding door having a displaceably mounted door leaf, the sealing device comprising:

a drop-down seal having a sealing strip and a lowering mechanism for automatically lowering and lifting the sealing strip, wherein the lowering is performed counter to a restoring force; and an activation unit for activating the drop-down seal, wherein the activation unit has a bearing face, wherein the bearing face is directed upward, and wherein the activation unit has a pivot module with a first arm and a second arm, wherein the first arm is a bearing element which, in closing of the door leaf, bears on said bearing face and activates the drop-down seal, and wherein the second arm of the pivot module activates the drop-down seal.

2. The sealing device as claimed in claim 1, wherein the bearing element in the closing of the door leaf bears on the bearing face and activates the lowering mechanism and thus the drop-down seal.

3. The sealing device as claimed in claim 1, wherein the activation unit is configured for holding the sealing strip in a lowered position without the restoring force influencing any sliding movement of the door leaf in a longitudinal direction of the sealing strip.

4. The sealing device as claimed in claim 3, wherein a position of the bearing element on the bearing face is present, in which position the sealing strip is fully lowered and the restoring force acting on the sealing strip is deflected in a direction perpendicular to the longitudinal direction of the sealing strip.

5. The sealing device as claimed in claim 1, wherein the bearing face is a slide face and the bearing element is a slide element which, in the closing of the door leaf, slides along said bearing face and activates the lowering mechanism.

6. The sealing device as claimed in claim 1, wherein the bearing face, in a longitudinal direction of the drop-down seal, at least in part runs obliquely.

7. The sealing device as claimed in claim 6, wherein the bearing face, in the closing direction of the door leaf, runs from bottom to top.

8. The sealing device as claimed in claim 6, wherein the bearing face has a downwardly directed oblique counter-face on which the bearing element bears in the lowered position of the sealing strip.

9. The sealing device as claimed in claim 1, wherein the bearing face has a horizontally running portion on which the bearing element bears so as to hold the sealing strip in a lowered position.

10. The sealing device as claimed in claim 1, wherein the bearing face has a depression in which the bearing element bears so as to hold the sealing strip in a lowered position.

11. The sealing device as claimed in claim 1, wherein the bearing face is disposed so as to be locationally fixed, and the bearing element is displaceable conjointly with the drop-down seal.

12. The sealing device as claimed in claim 11, wherein the bearing element is fixedly connected to the drop-down seal, and the bearing face is configured in a module that is separate from the drop-down seal.

13. The sealing device as claimed in claim 1, wherein the lowering mechanism has an activation button which activates the lowering mechanism by way of an influence of external force, and wherein the bearing element acts indirectly or directly on this activation button so as to lower the sealing strip.

14. The sealing device as claimed in claim 1, wherein the bearing element is a lever arm.

15. A sliding door having a displaceably mounted door leaf and a sealing device, the sealing device comprising:

a drop-down seal having a sealing strip and a lowering mechanism for automatically lowering and lifting the sealing strip, wherein the lowering is performed counter to a restoring force; and an activation unit for activating the drop-down seal, wherein the activation unit has a bearing face, wherein the bearing face is directed upward, wherein the activation unit has a pivot module with a first arm and a second arm, wherein the first arm is a bearing element which, in closing of the door leaf, bears on said bearing face, and wherein the second arm of the pivot module activates the drop-down seal when the first arm bears on said bearing face.

16. An activation unit of a sealing device, the sealing device comprising:

a drop-down seal having a sealing strip and a lowering mechanism for automatically lowering and lifting the sealing strip, wherein the lowering is performed counter to a restoring force; and the activation unit for activating the drop-down seal, wherein the activation unit has a bearing face, wherein the bearing face is directed upward, and wherein the activation unit has a pivot module with a first arm and a second arm, wherein the first arm is a bearing element which, in closing of the door leaf, bears on said bearing face, wherein the second arm of the pivot module activates the drop-down seal when the first arm bears on said bearing face, and wherein the activation unit has a first module which configures the bearing face, and has a second module which has a fastening element for fastening the drop-down seal in the door leaf as well as the bearing element that is disposed on the fastening element.

17. A sealing device of a sliding door having a displaceably mounted door leaf, the sealing device comprising:

a drop-down seal having a sealing strip and a lowering mechanism for automatically lowering and lifting the sealing strip, wherein the lowering is performed counter to a restoring force; and an activation unit for activating the drop-down seal, wherein the activation unit has a bearing face, wherein the bearing face is directed upward, wherein the activation unit has a bearing element which, in closing of the door leaf, bears on said bearing face and activates the drop-down seal, wherein the bearing face, in a longitudinal direction of the drop-down seal, at least in part runs obliquely, and wherein the bearing face, in the closing direction of the door leaf, runs from bottom to top.

18. The sealing device as claimed in claim 17, wherein the lowering mechanism has an activation button which activates the lowering mechanism by way of an influence of external force, and wherein the bearing element acts indirectly or directly on this activation button so as to lower the sealing strip.

* * * * *